United States Patent [19]

Wullenwaber

[11] 4,092,055

[45] May 30, 1978

[54] PARTS-HANDLING MAGAZINE

[76] Inventor: Robert W. Wullenwaber, 1141 St. Regis Pl., Santa Ana, Calif. 92705

[21] Appl. No.: 611,523

[22] Filed: Sep. 8, 1975

[51] Int. Cl.[2] ..... A47F 1/00

[52] U.S. Cl. ..... 312/45; 206/378; 312/42; 312/229

[58] Field of Search ..... 312/35, 42, 45, 228; 2/279, 351; 206/328

[56] References Cited

U.S. PATENT DOCUMENTS

| | | | |
|---|---|---|---|
| 3,194,620 | 7/1965 | Sauer | 312/45 |
| 3,393,797 | 7/1968 | Flood | 312/45 |

*Primary Examiner*—Casmir A. Nunberg
*Attorney, Agent, or Firm*—William L. Chapin

[57] ABSTRACT

A container or magazine for processing, storing and shipping cylindrical parts is described. Bulk parts randomly oriented with respect to one another are brought into parallel alignment by operation of the magazine, facilitating the utilization of the parts in manufacturing operations.

17 Claims, 5 Drawing Figures

PARTS-HANDLING MAGAZINE

BACKGROUND OF THE INVENTION

Present methods of storing, shipping and routing small cylindrical parts through manufacturing operations often result in distortion of and damage to the parts. Axial lead electronic components such as resistors, capacitors and diodes are particularly susceptible to being broken or having their leads bent in the course of normal handling employing present methods.

The shortcomings of present component handling methods are particularly keenly felt by electronic component manufacturers. The latter typically produce a variety of shapes, sizes and grades of components which must be subjected to processing operations that are varied in scope. Storage and handling of the components between processing operations is often done in boxes containing the components in bulk. The bulk storage of the components often result in their becoming randomly aligned with respect to one another and intertwined to form haystack-like piles. This jumbling of parts not only necessitates the re-alignment of the parts into more nearly parallel relative orientation for succeeding manufacturing operations but also often results in bent leads or damaged components. Hence, interim rework operations are required to remove damaged parts, straighten those leads that are bent, and realign the parts into the parallel orientation and polarity sense required for succeeding manufacturing operations. The manufacturer using finished components in his products has handling problems similar to those just described. Although high-volume manufacturers employing automatic insertion equipment often receive axial lead components on tape reels, the small manufacturer or manufacturer building small quantities of assemblies cannot justify the cost of using automatic insertion equipment. Furthermore, the cost of tape-reel mounted components is usually higher than the cost of bulk parts. Also, removal of the parts from tape is an additional operation required before insertion of the parts, still further increasing the cost to the user of tape-reel mounted components. Finally, the adhesive used in the tape holding components has only a finite shelf life, after which it deteriorates and becomes ineffective in holding components.

The present invention overcomes the above described problems in handling cylindrical components, and in particular overcomes the problems associated with pure gravity-feed devices. The invention is well adapted to handling fragile glass or ceramic rods, tubes, wire products, spacers, screw stock and cigarettes, for example, in addition to the components previously described.

OBJECTS OF THE INVENTION

An object of this invention is to provide the means to bring into substantially parallel alignment cylindrical components obtained from randomly-oriented bulk stocks, or from preceding manufacturing operations.

Another object of the invention is to provide the means to facilitate sequential dispensing of individual components obtained from bulk stocks. Another object of the invention is to provide protective enclosure means for cylindrical parts that maintains the parts in substantially parallel alignment, and protects the parts from mechanical damage and harmful environmental conditions during transportation, storage, and manufacturing operations.

Another object of the invention is to provide efficient container means for parts undergoing processing operations such as washing, coating, deburring and deflashing.

Another object of the invention is to provide a convenient means for performing inventory of stored parts. Various other objects and advantages will appear from the following descriptions of one embodiment of the invention, and the most novel features will be particularly pointed out hereinafter in connection with the appended claims.

BRIEF SUMMARY OF THE INVENTION

Briefly stated this invention comprehends a parts-handling container or magazine providing means for performing parallel alignment, transportation and storage of cylindrical components. The magazine comprises a plurality of at least two chambers each with substantially horizontal upper and lower surfaces and substantially vertical sides. The chambers are disposed in a serial vertical arrangement with vertical passageways joining each vertically-adjacent pair of chambers. Vibration of the magazine in a horizontal plane causes parts admitted into the open top of the uppermost chamber to fall into lower chambers, the parts becoming increasingly more nearly parallel aligned in progressing from top to bottom of the magazine. A progressive reduction in the height of the chambers in proceeding from the top to bottom of the magazine facilitates the re-alignment of parts into parallel orientation.

BRIEF DESCRIPTION OF THE DRAWINGS

The numerous benefits and unique aspects of the present invention will be fully understood when the following detailed description is studied in conjunction with the drawings in which.

DETAILED DESCRIPTION OF THE PREFERRED EMBODIMENTS

Figure 1:
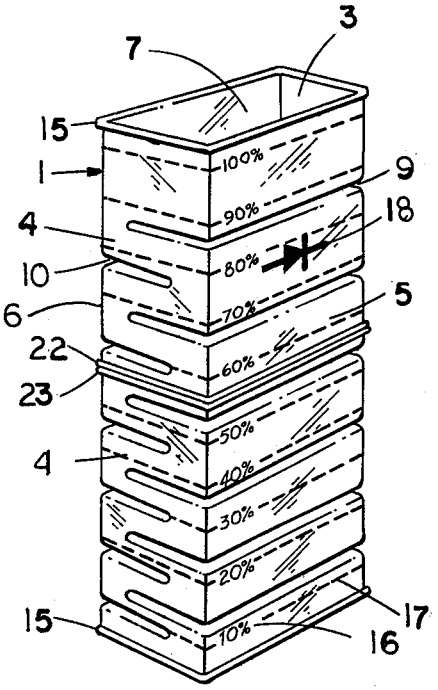
FIG. 1 is a perspective view of the preferred embodiment of the magazine, showing alternating lateral wall indentations that taken together form the individual parts chambers and the vertical passageways between adjacent chambers.
Figure 3:
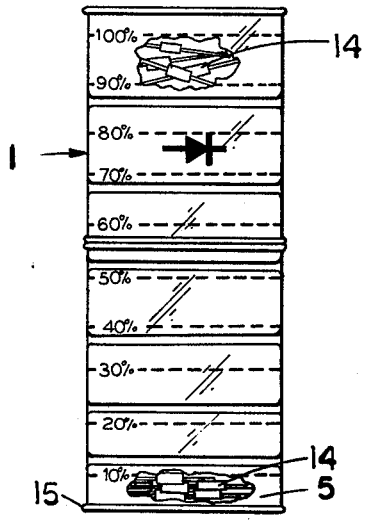
FIG. 3 is a partially fragmented front elevation view of the magazine showing the more nearly parallel disposition of parts in the bottom chamber of the magazine as compared to the more randomly oriented parts in the top chamber of the magazine.
Figure 2:
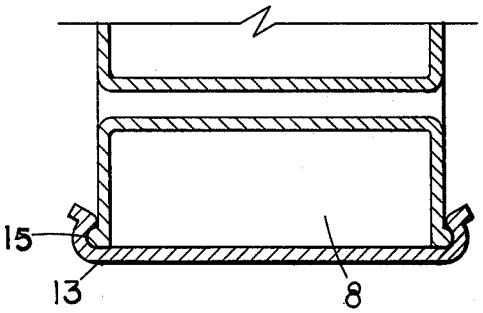
FIG. 2 is a front elevation sectional view of the magazine showing the attachment of a flexible closure that snaps over ribs protruding laterally from the magazine walls near the bottom of the bottom chamber.
Figure 4:
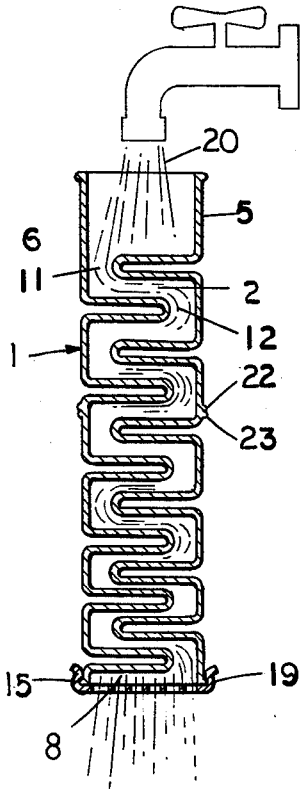
FIG. 4 is a side elevation sectional view of the magazine showing the path of a processing fluid through the chambers and interconnecting passages therebetween, with the fluid exiting the magazine through perforations in a snap-fit bottom closure that is an alternate embodiment of the closure shown in FIG. 2.

Referring now primarily to FIGS. 1 and 4 and also to FIGS. 2 and 3, a parts-handling magazine 1 is shown that comprises a stack of vertically disposed interconnected chamber 2. A pair of parallel vertical walls 3 and 4, and a second pair of vertical walls 5 and 6 form a rectangular-horizontal-section, vertical entrance opening 7 and a rectangular-horizontal-section, vertical exit opening 8. Walls 5 and 6 have a plurality of essentially rectangular cross-section indentations 9 and 10 which protrude horizontally into the interior of the magazine. The protrusions extend beyond that vertical center plane which is parallel to walls 5 and 6. Upper and lower surfaces of alternate pairs of wall indentations 9 and 10 form essentially horizontal top and bottom inner surfaces that comprise the top and bottom surfaces of chambers within the magazine. Vertical parallel walls 3 and 4 form two of the side walls of each of the chambers, while the vertical portions of walls 5 and 6 form the third vertical wall for each of the chambers adjacent to walls 5 and 6 respectively. Those vertical surfaces of indentations 9 and 10 that extend within the interior of the magazine, together with the opposing inner vertical surfaces of walls 5 and 6, respectively, form vertical passageways such as 11 and 12, between adjacent chambers; 2 indicating a typical chamber. The vertical spacing between adjacent inner horizontal surfaces of wall indentations 9 and 10 is successively smaller in progressing from the top of the magazine to the bottom. The magazine is used to improve the alignment of bulk parts with respect to one another preparatory to the usage of individual parts in manual or automatic manufacturing operations, as follows.

Bulk parts are loaded into the top chamber of the magazine through opening 7, with the predominantly long directions of the parts, i.e., their cylindrical axes, oriented approximately perpendicular to walls 3 and 4. Manual or other suitable means are used to vibrate or shake the magazine in a horizontal plane. The inertia of the parts, acting in conjunction with the low coefficient of sliding and rolling friction between the parts and the smooth interior horizontal surfaces of the chambers, allows the magazine to move laterally with respect to the parts. This lateral movement permits the parts to fall through vertical interconnecting passageways to adjacent lower chambers, such as for example through passageway 11 into chamber 2. The interior height of chamber 2 constrains parts entering chamber 2 to lie in more nearly horizontal positions than the bulk parts introduced through opening 7. As vibration of the magazine is continued, parts in chamber 2 progress downward through passageway 12 into the next lower chamber. In an exactly similar way, continued lateral vibration of the magazine in a horizontal plane causes parts to progress downward, with parts first introduced ultimately coming to rest in the bottom chamber of the magazine, that chamber being comprised of opening 8 and closure 13. The successively smaller interior heights of the chambers experienced by the parts travelling down through the magazine causes the parts to become successively more closely horizontally oriented. FIG. 3 shows typically misoriented parts 14 in entrance chamber 7, and also shows parts 14 in more nearly parallel alignment on the surface of closure 13, after having progressed through the magazine under the combined forces of lateral vibration and gravity.

The interior distance between walls 3 and 4 may be made sufficiently larger than the axial length of parts to be processed to permit side by side disposition of oriented parts 14 as shown in FIG. 3.

In performing the orientation of parts by the method described, introduction of parts into the magazine may continue until every compartment is substantially full. A closure identical to closure 13 used to seal bottom chamber 8 may then be used to close the top of the magazine. By thus providing both bottom and top closures, parts contained within the magazine may conveniently be stored and transported.

Horizontally disposed and protruding ribs 15 are provided on opposite sides of the magazine near the entrance opening 7 and exit opening 8. A shallow tray-like rectangular closure with flexible indentations adapted to snap over the ribs is used to seal the magazine entrance and exit, and may be readily removed and refastened as desired.

To minimize the possibility of parts catching on any interior surface of the magazine, the preferred method of fabricating the magazine is by molding from a plastic material. Suitable molding processes include blow-molding, injection molding, or vacuum forming.

To facilitate the rolling and sliding of parts during the vibration of the magazine, the material used for fabricating the magazine should have a low coefficient of friction, such as may be provided by nylon or polyethylene. If the magazine is fabricated from a transparent or semi-transparent material, an inventory of the approximate number of parts contained in the magazine may be readily performed. The parts count estimate is made pre-determining the count for a full magazine, and thereafter noting the percentage number 16 of that line 17 marked on the magazine which is closest to the maximum parts level, as determined by viewing through the walls of the magazine. A mark 18 indicates correct parts polarity. FIG. 4 shows magazine 1 being used to hold parts undergoing a processing operation such as washing or coating. In that embodiment, the bottom of the magazine is fitted with a perforated closure that is an alternate embodiment of solid closure 13. The perforations in closure 19 permit processing fluid 20 that has been introduced into opening 7 of the magazine and that has subsequently passed through the chambers and passageways in contact with the parts within the magazine, to exit from the magazine. By placing a second perforated closure 19 on the top of the magazine, the entire magazine may be immersed in a processing fluid, and if required, vibrated while the parts are held within the magazine. Processing operations such as polishing, deflashing or deburring may be performed by placing suitable solutions in the magazine and vibrating it.

Figure 5:
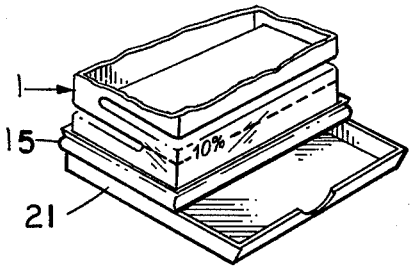
FIG. 5 is a fragmentary perspective view of the magazine showing another alternate embodiment of a snap-fitting bottom closure that comprises a dispensing tray for easy manual removal of individual parts.

FIG. 5 shows another alternate embodiment of the magazine bottom closure. This closure comprises a notched tray 21 that extends laterally beyond a vertical wall of the magazine. The lateral extension has two substantially vertical side surfaces and a substantially vertical front lip to constrain parts delivered to the tray to remain in parallel alignment. A centrally located thumb relief notch in the edge of the vertical lip facilitates manual removal of one or more parts at a time, as required.

FIG. 1 and 4 show adjacent pairs of laterally protruding, laterally disposed ribs 21 and 23 similar to closure-engaging locking ribs 15. The vertical distance between adjacent rib pairs is sufficient to permit a cutting means to horizontally bisect the magazine into two smaller vertical sections. The two sections resulting have functional capabilities essentially similar to those just described for the larger, parent magazine. Thus a single magazine size and type provide the user with the capability of readily modifying the magazine to produce smaller magazines as required.

From the foregoing, it will be evident that the present invention has provided a parts-handling magazine which has many useful and novel features.

What is claimed is:

1. A parts-handling magazine comprising a plurality of at least two vertically disposed chambers interior to two pairs of substantially vertical walls, the first pair of vertical walls lying substantially within two parallel vertical planes, the second pair of vertical walls having a plurality of indentations of substantially rectangular vertical cross section, the indentations spanning the interior distance between the first pair of vertical walls and extending horizontally into the interior of the magazine beyond that vertical center plane of the magazine which is parallel to the indented second pair of vertical walls, the indentations in opposite walls alternating in vertical position with one another to form a series of interdigitated, horizontal protuberances having rectangular cross sections within the magazine interior, the upper substantially horizontal surfaces of the protuberances forming the lower interior surfaces of parts-holding chambers, the lower substantially horizontal surfaces forming the upper interior surfaces of parts-holding chambers, and the parallel opposition of the inner vertical surfaces of the protuberances with vertical interior wall surfaces forming substantially vertical, rectangular cross-section passages between adjacent chambers.

2. A structure according to claim 1 wherein the interior height of at least one lower chamber is less than the interior height of at least one upper chamber.

3. The structure according to claim 1 including protrusions extending laterally outward from at least one pair of vertical wall surfaces near the bottom of the magazine, each protrusion extending horizontally along the outer surface of the supporting wall and adapted to snap into mating slots in a flexible tray-like closure adapted to fit over the bottom of the magazine.

4. The structure according to claim 3 wherein the interior height of at least one lower chamber is less than the interior height of at least one upper chamber.

5. The structure according to claim 3 including protrusions extending laterally outward from at least one pair of vertical wall surfaces near the top of the magazine, each protrusion extending horizontally along the outer surface of the supporting wall and adapted to snap into mating slots in a flexible tray-like closure adapted to fit over the top of the magazine.

6. The structure according to claim 5 wherein the interior height of at least one lower chamber is less than the interior height of at least one upper chamber.

7. The structure according to claim 5 wherein at least part of at least one wall is adapted to permit viewing through the wall to determine the level of parts within the magazine.

8. The structure according to claim 6 wherein at least part of one wall is adapted to permit viewing through the wall to determine the level of parts within the magazine.

9. The structure according to claim 5 including on opposite sides of the horizontal center plane of the magazine at least two pairs of protrusions extending laterally outward from at least one pair of vertical wall surfaces near the horizontal center plane, each protrusion extending horizontally along the outer surface of the supporting wall, the vertical spacing between pairs of protrusions on opposite sides of the center plane sufficient to admit a cutting tool adapted to bisect the magazine in the horizontal center plane into two substantially similar vertical sections.

10. The structure according to claim 9 wherein the interior height of at least one lower chamber is less than the interior height of at least one upper chamber.

11. The structure according to claim 9 wherein at least part of at least one wall is adapted to permit viewing through the wall to determine the level of parts within the magazine.

12. The structure according to claim 11 wherein the interior height of at least one lower chamber is less than the interior height of at least one upper chamber.

13. The structure according to claim 12 including a bottom tray-like closure that extends laterally outward beyond a vertical wall of the magazine, the lateral extension having two parallel, substantially vertical side edges and a substantially vertical front edge, the three edges having sufficient height to confine parts to the tray surface extension between the edges, and a centrally located notch in the front edge adapted to facilitate removal of parts from the tray extension.

14. The structure according to claim 12 including a bottom tray-like closure that seals the bottom of the magazine.

15. The structure according to claim 12 including a perforated bottom tray-like closure.

16. The structure according to claim 12 including a bottom tray-like closure that seals the bottom of the magazine, and an inverted tray-like closure that seals the top of the magazine.

17. The structure according to claim 12 including a perforated tray-like closure fitted to the bottom of the magazine and an inverted, perforated tray-like closure fitted to the top of the magazine.

* * * * *